US005259696A

United States Patent [19]

Beardsley

[11] Patent Number: 5,259,696

[45] Date of Patent: Nov. 9, 1993

[54] MEANS FOR AND METHOD OF BEACH REBUILDING AND EROSION CONTROL

[76] Inventor: Melville W. Beardsley, 2690 Walker Ave., Carmel, Calif. 93923-9242

[21] Appl. No.: 841,669

[22] Filed: Feb. 24, 1992

[51] Int. Cl.[5] ..... E02B 3/12

[52] U.S. Cl. ..... 405/73; 405/25

[58] Field of Search ..... 405/15, 19, 21, 25, 405/26, 52, 73, 80

[56] References Cited

U.S. PATENT DOCUMENTS

| | | | |
|---|---|---|---|
| 339,548 | 4/1886 | Haupt | 405/80 |
| 978,897 | 12/1910 | Kelley | 405/73 X |
| 1,643,691 | 9/1927 | Bignell | 405/73 |
| 2,185,458 | 1/1940 | Gilasso | 405/26 |
| 4,946,308 | 8/1990 | Chevalier | 405/15 |

FOREIGN PATENT DOCUMENTS

| | | | |
|---|---|---|---|
| 55819 | 9/1952 | France | 405/73 |
| 1236057 | 6/1986 | U.S.S.R. | 405/26 |
| 1446212 | 12/1988 | U.S.S.R. | 405/73 |

*Primary Examiner*—Randolph A. Reese
*Assistant Examiner*—John Ricci
*Attorney, Agent, or Firm*—William K. Rieber

[57] ABSTRACT

A system for rebuilding beaches which are subject to erosion of sand comprises a sheet of flexible impermeable material placed in the ocean near the shore and anchored to the water bottom with a plurality of landward tethers and a plurality of seaward tethers. A shoreward edge of the sheet parallel to the shoreline is weighted down. A seaward edge of the sheet, also parallel to the shoreline, may be provided with a float device to tend to raise the edge. As waves travel from the ocean toward the beach, the water is deflected under the sheet by the raised seaward edge, and into contact with sand and soil under the sheet, causing the sand and soil to move toward the beach. However, during the backwash of the wave, the weighted beachward edge of the sheet rests on the water bottom, deflecting the water over the sheet and out of contact with the sand and soil under the sheet, preventing movement of sand and soil away from the beach.

9 Claims, 3 Drawing Sheets

MEANS FOR AND METHOD OF BEACH REBUILDING AND EROSION CONTROL

A method of rebuilding and controlling the erosion of beaches incorporating a thin flexible sheet to separate and influence surf flow currents to cause the buildup and seaward expansion of a beach, and to prevent the narrowing or shoreward contraction of the beach due to erosion. The sheet, held near the sea-bed at a fixed location in the surf zone, separates counterflowing currents in a manner to inhibit turbulence, conserve kinetic energy and utilize the same to move suspended sediment particles, e.g. sand, predominantly toward the shore. The particle movement terminates with deposition on, and resulting buildup of, the beach.

The thin flexible sheet also shields the transitional beach-to-sea-bed surface from direct impingement of plunging surf; thereby inhibiting erosion resulting from dislodged particles being carried away by the agitated surf.

DEFINITIONS

In order to make clear and specific the descriptions and discussions relating to this invention, a definition of the terms involved is desirable. These definitions apply to the descriptions and discussions to follow. Those marked * are taken directly from the *SHORE PROTECTION MANUAL*, produced by the Coastal Engineering Research Center, Department of The Army, Waterways Experiment Station, Corps of Engineers.

backwash: The receding flow of a wave down the beach after reaching its highest point and reversing its flow.

beach*: The zone of unconsolidated material that extends landward from the low waterline to the place where there is a marked change in material physiographic form, or to the line of permanent vegetation (usually the effective limit of storm waves).

beach erosion*: The carrying away of beach materials by wave action, tidal currents, littoral currents, or wind.

breaker zone: The area of the surf zone in which waves break.

bed-load transport*: Movement of granular material such as coarse sand dislodged from a stream-bed or ocean-bed, not fully suspended by the water, but migrates by a rolling or bouncing action induced by the shear of a bottom current.

buildup: Deposition of water-borne materials on the beach surface.

bulkhead*: A structure or partition to retain or prevent sliding of land. A secondary purpose is to protect the upland against damage from wave action.

chord: The length between the leading edge and the trailing edge of the flow-control sheet.

flow-control sheet: A thin flexible sheet held near the surf zone bottom surface at a fixed location in the surf zone to influence the surf flow.

FCS: Abbreviation of "flow control sheet".

in-flow: Flow toward land.

jetty*: On open seacoasts, a structure extending into a body of water, which is designed to prevent shoaling of a channel by littoral materials and to direct and confine the stream or tidal flow.

leading edge: The seaward, or outer, edge of the flow-control sheet.

outer: Referring to the edge, portion, or direction away from land.

out-flow: flow away from land.

plunge point: Location of the point of bottom impact of the plunging water produced by a breaking wave.

revetments*: A facing of stone, concrete, etc., built to protect a scarp, embankment, or shore structure against erosion by wave action or currents.

sediment: Particulate solids suspended in, or moved by a body of water.

shore*: A narrow strip of land in immediate contact with the sea, including the zone between high and low tidal water levels.

shoreline*: The intersection of a specified plane of water surface with the shore or beach.

span: The dimension of the flow-control sheet parallel to the shoreline.

spanwise: Parallel to the shoreline.

surf: The wave activity in the surf zone, q.v.

surf zone*: The strip along the juncture of the beach and sea bed bounded to seaward by the outermost breakers and a- shore by the highest point of the swash, q.v.

swash*: The rush of water up onto the beach face following the breaking of a wave. Also referred to as uprush or runup.

trailing edge: The shoreward, or inner, edge of the flow control sheet.

BACKGROUND of INVENTION

Damage resulting from beach erosion is well documented. Hundreds of millions of dollars have been spent to repair such damage; some is irreparable. Beaches provide a buffer to absorb the energy of storm waves, preventing them from destructively crashing into seashore buildings and other property. When the protective beach has been lost due to erosion, the adjacent structures and the land itself are exposed to direct attack by the storm waves. Loss of a beach due to erosion has not only resulted in the destruction of buildings and the loss of land, but has jeopardized the livelihood and existence of resort communities.

At the present time, around 1990, beach replenishment by traditional means attracts more attention and money than the prevention of beach erosion. The process of replenishment replaces or augments the eroded sand beach with large volumes of new sand trucked in or pumped in from offshore areas. Beach replenishment is a stop-gap remedy for an eroded beach but it is not a cure for beach erosion. Periodic maintenance by piling more sand onto the beach is always necessary. Thus the replenishment process is expensive and never-ending.

The well known replenishment of the beach at Miami Beach, Fla., cost a reported $65 million. Virginia Beach, Va., has paid about $1.5 million per year for 30-plus years to haul in replacement sand. Seabright, N.J., is reported spending $158 million to repair its seawall and restore its beaches.

One authority has estimated, as of 1988, that it would probably take 10 years and $300 million to undo the damage already done to Florida's southern beaches and prevent further erosion. These examples emphasize the fact that beach erosion is costly.

Over the years, many means to prevent beach erosion have been proposed and tried. In general, these measures have proven costly and of limited effectiveness over a period of time. Revetments, bulkheads, seawalls, and jetties are major structures. They require heavy materials to be transported and set in place under often-difficult conditions. Cost for the installation of these structures is in the order of hundreds of dollars per linear foot of shoreline.

The destruction and great costs produced by beach erosion clearly demonstrate that there exists a need for more permanent and less costly means to accomplish beach replenishment and the prevention of erosion.

Stimulated by this existing need, many inventions have been conceived and proposed for preventing beach erosion by means other than by the previously mentioned revetments, seawalls, etc. In general, these inventions are objects placed on the beach surface for the purpose of dissipating the energy of the surf to reduce its destructive power, or for the purpose of trapping beach sand that had been raised into suspension by the agitated waters.

It might be generalized that, as to the energy of the surf, most of these inventions are either dissipative or passive. In contrast, it is desirable to utilize the energy of the surf to build up the beach. This is the primary objective of my invention.

Beach erosion—defined by the official *SHORE PROTECTION MANUAL*—is "the carrying away of beach materials by wave action, tidal currents, or wind". It is evident that beach erosion will be greatly reduced if the "carrying away" action is prevented. "Carrying away" by wave action occurs when beach materials (e.g. sand) have been dislodged from the bottom surface, stirred into suspension, and then swept seaward by the turbulent surf flow.

If the beach materials were not completely dislodged and separated from the bottom surface they would not be raised into suspension subject to being carried away. Thus, beach erosion caused by wave action will be largely prevented if beach materials are retained on the bottom surface and not completely dislodged and free therefrom. This is another of the features of my invention.

One physical principle which is employed in carrying out the objectives of my invention is the optimum use of the kinetic energy of a breaking wave driven against a sloping beach. This kinetic energy nears its maximum as a wave approaches the plunge point. This maximum kinetic energy acts to dislodge and transport sediment as the incoming wave flows up the beach, reaches zero velocity and flows back down the beach to the sea.

The sediment carrying capacity of a body of water moving along an unconsolidated surface such as a sandy beach is primarily a function of the velocity of flow. That is to say, the higher the flow velocity the greater will be the number, weight, and size of solid particles that can be carried by the moving body of water.

In order to make optimum beach-building use of the energy developed by breaking waves, my invention employs means to effect maximum dispersion of sediment into the wave stream during the period of its maximum shoreward velocity, i.e., during the swash portion of the wave cycle, and minimizing sediment dispersion into the waves during the backwash portion of the cycle.

Dispersion of sand and other sediment into the moving surf flow occurs primarily at, or near the plunge point where the plunging surf impacts the sea-bed and dislodges and stirs up sand particles from the bottom.

Beach buildup occurs when the dislodged particles are carried up the beach and deposited as the surf run-up terminates. Reversing its direction, the flow returns back down the beach. Beach erosion occurs when dislodged sediment remains in suspension during the wave flow reversal and is carried out to sea by the backwash.

In ideal conditions the buildup equals or slightly exceeds the erosion and the beach continues to grow, or, at worst, remains of the same extension. But such ideal conditions do not often persist over long periods of time, however, in latitudes subject to relatively violent storms. During a severe storm the sediment-carrying capacity of both the swash and backwash is relatively high, but the swash cycle is of relatively short duration and the potential beach buildup is more than overcome by the longer lasting backwash which under storm conditions has velocity enough to dislodge and move sediment seaward.

An important objective of my invention is to make optimum use of the kinetic energy contained in a moving mass of water, i.e. a wave driven against a sloping beach. This kinetic energy is at or near its maximum as a breaking wave plunges downward at the plunge point. As the wave cycle continues beyond the plunge point, the kinetic energy dislodges and transports particles and is progressively expended reaching zero at a turn-around point where the wave ends its shoreward movement, drops its load of sediment, and drains back down the beach to the sea.

During high surf conditions there is usually an unfavorable imbalance of in-shore and off-shore sediment transport because under these conditions the backwash velocity is great enough to dislodge and transport sediment and is of longer duration than the swash.

My invention corrects this imbalance by restricting the in-flow to a relatively high velocity current immediately adjacent the sea-bed where the water is comparatively rich in dislodged sediment and by causing the out- flow or backwash to drain away in a relatively slowly moving surface-adjacent stream out of direct contact with a part of the bottom underlying the surf zone.

To achieve the objectives of my invention I also employ the operating principle that when a fluid flows over an unconsolidated surface composed of sediment particles such as sand, the total mass of particles moved is a function of the flow conditions along the surface, the amount of surface area exposed to the flow, and the duration of the flow. Therefore, to implement this principle in building up a beach, an embodiment of this invention should have two major operational features:

1. Conditions in the surf-zone must be such that the kinetic energy of the in-flow is employed to cause greater bottom scouring and sediment movement than is caused by the kinetic energy of the out-flow.
2. Such conditions should expose more area of the surf zone under-surface to the scouring in-flow than to the backwash.

These two operating features cause the surf in-flow to move more sediment, or sand, than does the surf out-flow. By this selective utilization of the energy of the surf in-flow, the resulting net movement of sand picked up from the sea-bed, is toward the shore, terminating with deposition on the beach.

These operating principles are implemented by use of a thin flexible sheet, herein designated "flow-control sheet" or FCS. It is fixed in its horizontal location over a portion of the sea-bed under the surf zone. The FCS is free to move vertically within limits, and has a buoyed seaward edge which causes the edge to be lifted away from the sea-bed by each surf in-flow. After the FCS edge has been raised, all or part of the surf in-flow passes beneath the sheet, applying its energy to dislodging and moving particles of sand along the bottom toward the shore.

When the in-flow stops, the weight of the shoreward edge of the flow-control sheet sinks it to rest upon the bottom. The ensuing out-flow then passes *over* the FCS, and out of contact with the sea-bed. Hence, the in-flow or swash is always in more intimate contact with the sea-bed than is the out-flow or backwash.

An important benefit of the cyclic flow diversion just described is that "bed load tranport" in a seaward direction is greatly reduced since loose sand remaining after the in-flow, that might otherwise be rolled out to sea is immobilized by the FCS until the next in-flow lifts the FCS and moves the loose sand shoreward.

To summarize, the above-described objectives are accomplished by the use of a flexible FCS suspended on or near the under-surface of the surf zone. The FCS is tethered in place by anchor lines leading from the seaward and shore-adjacent edges. The sheet is also caused to slope upwardly in a seaward direction by incorporating elongated floats in the seaward edge and a flexible elongated weight such as a chain in the shore-adjacent edge.

The tethers may be adjustable in length so as to make possible the movement of the entire flow-control sheet, seaward or shoreward, as wind and wave conditions dictate.

DESCRIPTION AND SUMMARY OF INVENTION

A presently preferred embodiment of my invention is illustrated in the accompanying drawings which are described as follows.

FIG. 2(*a*) is an enlarged vertical section through a portion of a breaking wave at the plunge point showing the flow distribution controlled by the FCS and the dislodging and entrapment of loosened sand particles under the FCS;

FIG. 4(*a*) is a vertical section taken at 4(*a*)—4(*a*) in FIG. 4;

Figure 6:
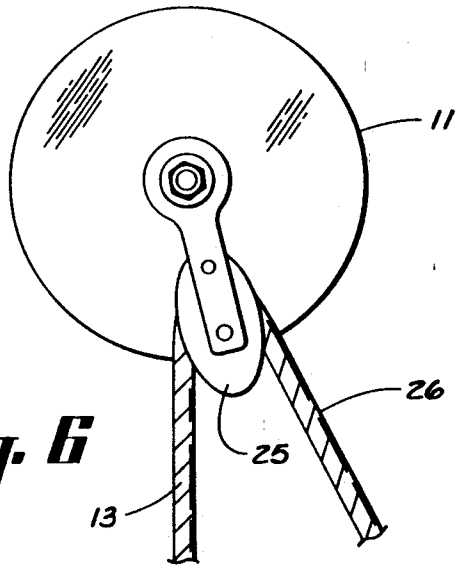
Figure 5:
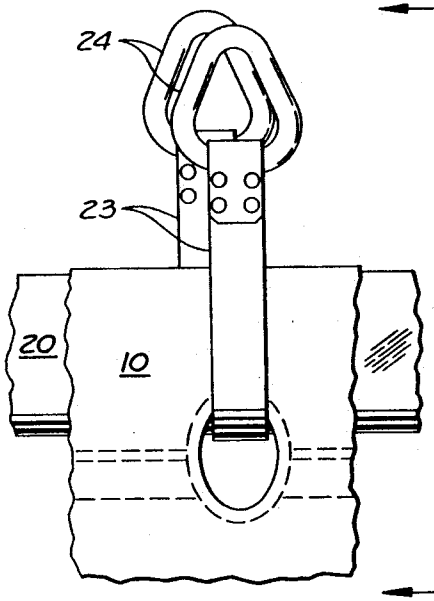
FIG. 5 shows an alternate form of tether connection employing an articulated solid float made up of unconnected sections of wood, cork, or polymerized plastic foam with a strap embracing each float section at its midpoint.
Figure 5A:
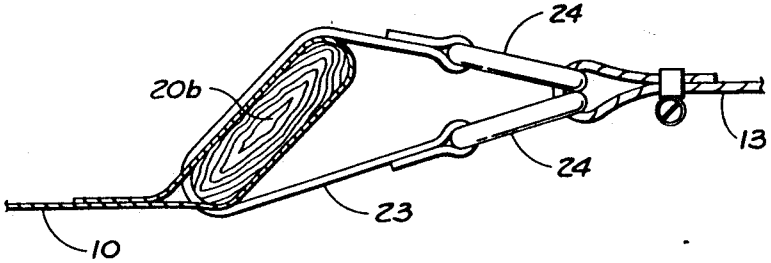

5(*a*) is a vertical section taken at 5(*a*)—5(*a*) in FIG. 5; and FIG. 6 is a plan view of pulley block installed at a seaward anchor to permit adjustment of the seaward tether length from a point on shore.

The general objective of this invention is to provide a method and structure for building up an eroded ocean beach by enhancing the transport of sand up the beach by the surf in-flow, and at the same time preventing further erosion by inhibiting sand removal by the surf out-flow.

Figure 1:
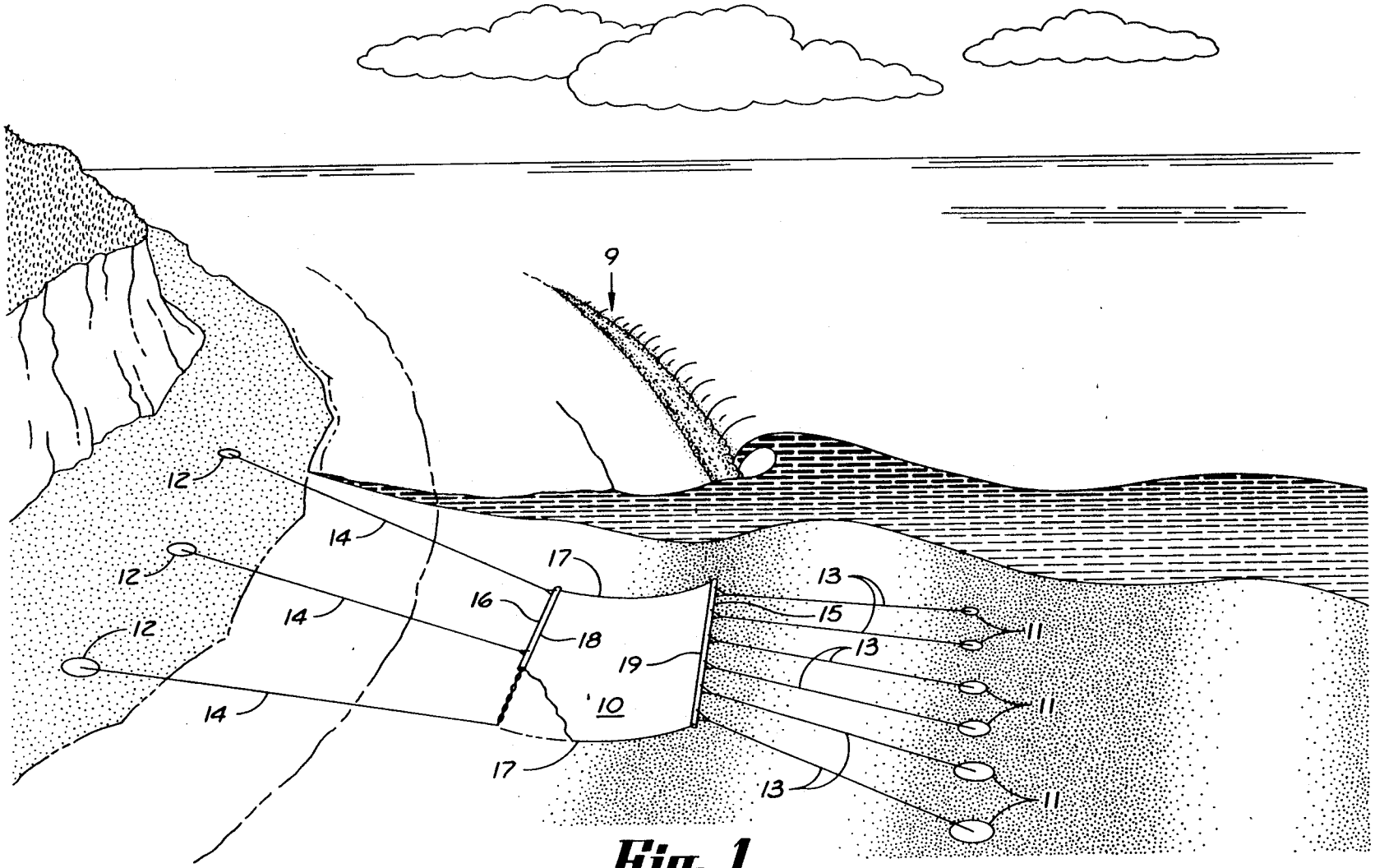
FIG. 1 is a perspective view of one section of FCS deployed on a beach surface in operative position, the sea water being not shown in the foreground, in order to reveal the anchor and tether locations.
Figure 2A:
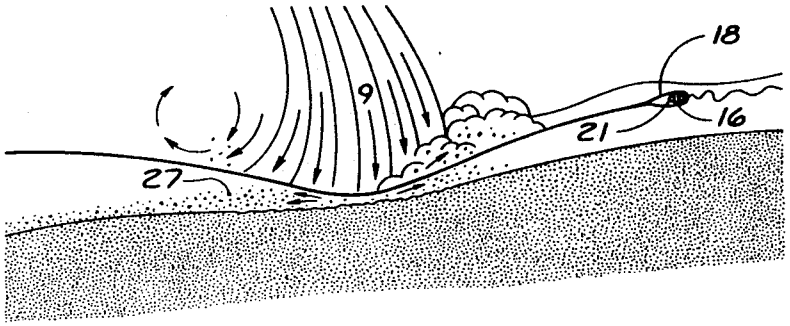
FIGS. 2 and 3 are vertical sections through the suspended FCS showing the positioning of the FCS and the current pattern during the surf in-flow and out-flow phases respectively, of a breaking wave cycle.
Figure 2:
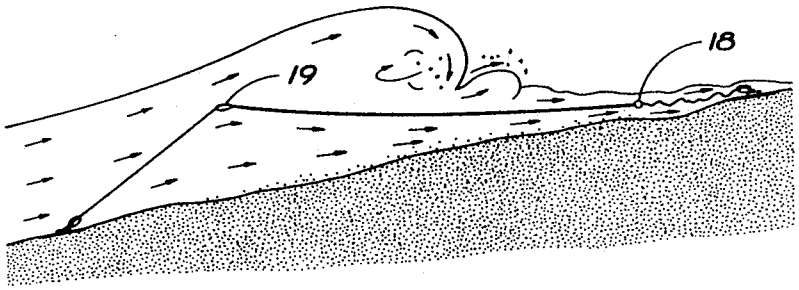

As shown in FIGS. 1 and 2, the primary element of my invention is a Flow Control Sheet (FCS) 10, an oblong polygonal sheet of flexible fabric located in the surf zone at or adjacent the plunge point 9 of the outermost breaking waves.

The FCS 10 is oriented with its major dimension generally parallel to the shore-line and is held in place by two rows of anchors 11 and 12 and tethers 13 and 14 attached along its seaward and shoreward edges 15 and 16 respectively.

The seaward anchors 11 to which the tethers 13 extend are positioned sufficiently remote from the FCS 10 that the tension exerted by the seaward tethers 13 is essentially horizontal thus permitting the buoyant seaward edge 15 to float freely on or near the water surface and not pulled deeper by tension of the tethers 13.

Figure 4A:
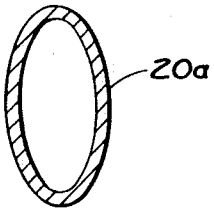
FIG. 4 is an enlarged fragmentary view of the juncture of two adjacent FCS units attached together to extend the area of beach to be treated and also showing an articulated float made up of separate hollow tubular sections hinged together with a tether connection in each hinge pin.
Figure 4:
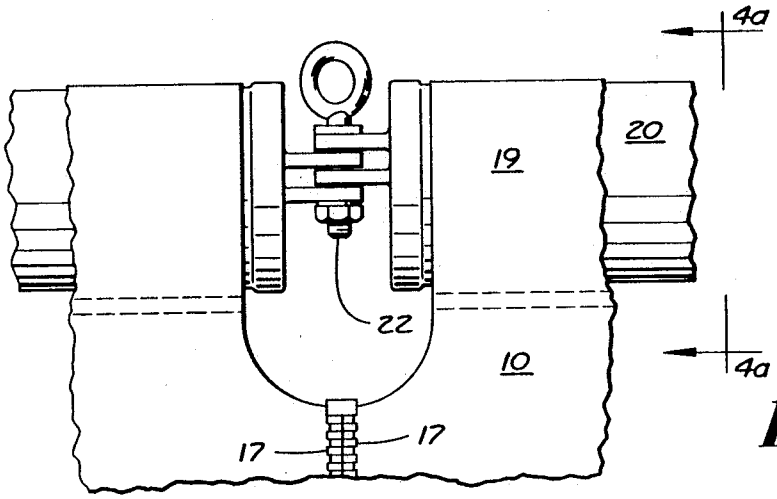
Figure 4:
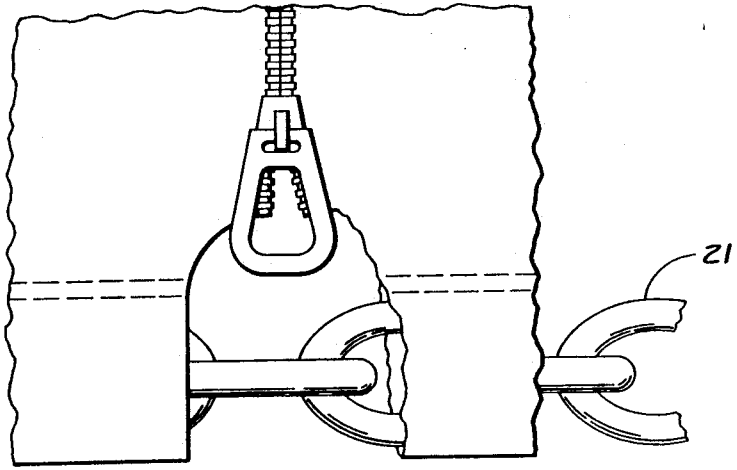

For ease in handling during deployment and removal the FCS 10 is preferably assembled from a series of units attached together along their lateral edges 17 as shown in FIG. 4.

In the presently preferred embodiment of my invention each FCS unit 10 is formed of polymer coated Nylon fabric cut in the general shape of a rectangle longer in its span than its chord, and covers an area of a fraction of an acre. The seaward edge of each FCS unit is made buoyant and the shoreward edge is weighted so that the FCS acts somewhat in the manner of a check valve arranged to direct the alternating swash and backwash of each successive wave into separate streams respectively below and above the FCS 10.

That is, the in-flow part of the wave cycle is constrained to a scouring stream *under* the FCS 10 exiting from under the weighted edge 16 and flowing up the beach to a turn-around point where it deposits transported sand. The returning out-flow, or backwash, now substantially sand-free, is directed *over* the FCS 10 separated from the sand yielding bottom surface by the FCS 10.

The respective buoying and weighting of the FCS edges 15 and 16 is effected in the presently preferred embodiment by hemming over the fabric to form transverse sleeves 18 and 19 to receive a series of rigid elongated floats 20 at the seaward edge and a flexible chain 21 at the shoreward edge 16. The floats 20 are of a flat elliptical cross section and may be tank-like hollow spar sections constructed of metal or plastic (20*a*) or solid lengths of wood or buoyant foam plastic (20*b*).

The floats 20 may be articulately joined together end-to-end so that they may be installed in the seaward sleeve 19 as a unit and still accommodate themselves to surface waves by flexure at the end joints.

In addition to furnishing buoyancy at the seaward edges 15 the rigid floats 20 serve to distribute the tension forces of the seaward tethers 13. This distribution of tension forces may be accomplished in several ways. For example, a seaward tether attachment may be provided by employing an eye bolt 22 as a hinge pin at the float interconnecting hinge as shown in FIG. 4. When this form of tether connection is used the FCS 10 is cut away at the end connection point to permit access to the tether connection.

An alternate form of tether connection is shown in FIG. 5 wherein each float section is embraced by a nylon strap 23 each end of which is also connected to a seaward-extending D-ring 24. In this form of tether connection only a small aperture need be formed in the FCS 10 so that the tension force is applied directly to a separate section of the float 20. Each float section may be spot-glued to the enclosing sleeve to hold it in its correct lateral position maintaining a small space between the ends of adjoining sections.

It is desirable under high surf conditions that the buoyancy of the floats 20 be augmented by the hydrofoil effect of the rigid floats reacting to the inflowing wave current. To accentuate such hydrofoil effect the tether attachment point may be located somewhat below the plane of the FCS 10 thus causing the seaward edge 15 to tilt up like a kite and drag the FCS up with it.

The FCS 10 can also perform an additional beneficial function in protecting the bottom surface from the direct disruptive effect of the breaking waves at the plunge point 9. The impingement of breaking waves on the bottom surface at the plunge point serves to dislodge and loosen the sand at that point. Without the FCS the downward stream of plunging water rebounds in all directions, carrying with it any sand loosened by the aforesaid impact.

Also, without the FCS the turbulent flow has out-flow components flowing in direct contact along the bottom at the plunge point. Such out-flow joins with the rebounding stream of plunging water and tends to carry the sand dislodged and loosened by the plunge impact out to sea.

However, as shown in FIG. 2(*a*), the addition of the FCS 10 significantly alters the action of the plunging surf. The bottom stream of out-flow is now separated by the FCS from direct contact with the bottom. Since water is essentially incompressible the downward kinetic impact is still delivered to the bottom and with a layer of water between the sheet and bottom operates to dislodge and loosen sand as described before but this loosened sand 27 is not carried away since there is no continuous current flowing *under* the FCS 10. The loosened sand 27 remains trapped under the FCS 10 until the next swash cycle carries it out from under the shoreward edge 16 and up the beach, where it is deposited.

An important feature of my invention is the ability to control the flow of the surf by positioning the FCS 10 in optimum position in the surf zone, near the sea-bed, with its edges 15 and 16 substantially parallel to the shoreline with the seaward edge near the plunge point 9.

Changing weather conditions and/or change in wave action may indicate the advisability of moving the flow control sheet either closer to, or farther from, the shoreline. To facilitate such adjustment the tethers 13 leading from the seaward anchors 11 to the seaward edges 15 may be threaded through sheaves 25 with the lead line 26 leading to a shore position. In this way the seaward tethers 13 can be lengthened by paying out, and the shoreward tethers 14 shortened by taking in the line, thus to drift the flow control sheet towards shore. Conversely the seaward tethers 13 may be shortened by taking in the tether lead line 26 while paying out the shoreward tethers 14 to pull the sheet seaward.

The operation of the flow-control sheet is favorably influenced by the flow conditions that normally exist along the sea-bed due to orbital wave action, as illustrated in charts and diagrams included in the authoritative text *BEACH PROCESSES AND SEDIMENTATION* by Paul D. Komar, Ph.D. The onshore velocity developed by the wave orbital action is considerably greater than the offshore velocity. Although the duration of the backwash is greater than that of the swash, the net movement of bottom sediment is toward the shore because the higher velocity dislodges and transports larger particles and the sediment carrying effectiveness of the flow is a function of the velocity to an exponential power. For instance, where the onshore/offshore velocity ratio is about 3, the ratio of the onshore/offshore transport effectiveness would be about $(3)^2=9$, assuming an exponent of 2 (which is lower than some test results indicate). In other words, for the same overall duration of wave cycle, the onshore sand movement would be nine times as great as the offshore movement.

Figure 3:
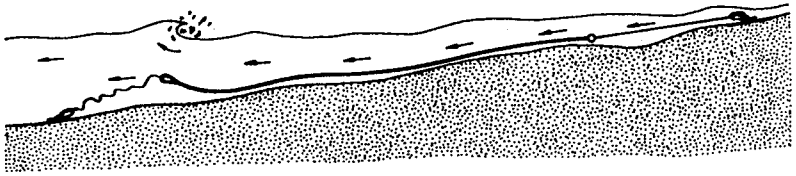

When the flow-control sheet of this invention is positioned over a sea-bottom surface area influenced by the orbital velocity conditions of FIG. 2, the onshore velocity and grain movement will remain about the same because the flow-control sheet when raised up off the bottom, allows the onshore flow to pass *under* it in scouring contact with the bottom surface. However, the scouring action of the offshore flow is decreased or eliminated in the area covered by the flow-control sheet because the offshore flow passes *over* the top of the flow-control sheet (see FIG. 3).

One of the advantages of the present invention under such storm conditions is that the FCS does not completely prevent the action of the plunging surf in dislodging and loosening sand from the sea bottom but immediately traps such loosened particles and prevents them from being carried to sea by any out-flow current. Such trapped sediment is moved shoreward by the next swash movement, however short in duration it may be.

When the waves become relatively steep and frequent as they do in storm conditions the dispersal of dislodged sand particles throughout the surf is relatively great. For this reason a large proportion of sediment remains in suspension throughout the wave cycle and is eventually carried seaward by the frequently dominant backwash current. It is under these conditions that beach erosion becomes the most deleterious. An advantage of the present invention lies in the fact that optimum benefit is taken of every inflow current, however short. This is for the reason that dislodged sand is trapped under the FCS or falls on the upper surface thereof, and in either case is moved shoreward by the next in-flow current. Such sand as may fall on the upper surface of the FCS is inhibited from being swept seaward due to the sloping orientation of the FCS maintained by the buoyancy of its seaward edge and the weight of its shoreward edge.

The foregoing discussion summarizes how this invention selectively utilizes the velocity and kinetic energy of the in-flowing surf to accomplish the function of building up a beach. It might be said that the function of the flow-control sheet is analogous to that of a check valve—it establishes a one-way movement of dislodged bottom sand toward the shore.

My invention can prevent beach erosion due to wave action by holding in place the particles, or sand, comprising the surf zone bottom material so that it is not carried away.

This holding of the particles in place may be accomplished with my invention by positioning the flow-control sheet over the bottom surface of the surf zone receiving the impact of the plunging discharge from the breaking waves. Resting on the sea-bed, the water-retardant flow-control sheet prevents the plunging water from making disruptive direct contact with the bottom surface. In effect, it puts a protective skin on the bottom surface. By preventing direct impact of the plunging surf against the sea-bottom, the FCS protects the bottom surface, holding the particles in place and preventing them from being carried away in a seaward direction.

Many modifications and uses will become apparent to those skilled in the art and I do not mean to be limited to the embodiments shown herein but rather to the scope of the appended claims.

I claim:

1. A flow control structure for rebuilding and protecting sloping ocean beaches which are subjected to a succession of in-rushing ocean waves each of which is driven up the beach by kinetic energy contained therein and recedes back down the sloping beach in a backwash current to the seat as a receding wave whereby an agitated surf zone is created where said backwash current of each wave encounters the succeeding in-rushing wave causing it to break over the backwash, said structure comprising:

a smooth-surfaced impervious flexible sheet having overall negative buoyancy adapted to lie on the sea-bed in the said surf zone confronting a beach to be treated with an edge facing seaward and the opposite edge facing shoreward;

lifting means formed along the seaward facing edge of said sheet to exert an upward force along said edge, tending to raise it from the sea-bed; and a plurality of anchor tethers, a first group extending seaward from laterally spaced points along said seaward edge to anchorage in the sea-bed and a second group extending from laterally spaced points along the shoreward edge to anchorage ashore whereby to restrain said sheet against horizontal displacement while permitting limited vertical movement of said edges in response to the kinetic forces of in-rushing breakers, and whereby to direct in-rushing flow of water into a sea-bed-scouring stream under said sheet and to separate said in-rushing flow from direct impingement against waters above said sheet.

2. The structure of claim 1 further characterized in that said lifting means is a flow-responsive hydrofoil formed along said seaward edge with said seaward tethers being attached to said hydrofoil at spaced points along the same whereby to distribute the tension stresses exerted on said sheet by said tethers and lift said seaward edge from the sea-bed in response to wave in-flow past said hydrofoil restrained by said tethers.

3. The structure of claim 1 further characterized in that said lifting means is comprised of a series of relatively rigid elongated floats secured end to end in a line along said seaward edge with each of said seaward tethers being attached to a float at spaced points along said line of floats whereby to distribute the tension stresses exerted on said sheet by said tethers.

4. The structure of claim 1 further characterized in that said lifting means is comprised of substantially continuous float means formed along said seaward edge to lift said seaward edge from the sea-bed.

5. The structure of claim 4 further characterized in that said shoreward extending tethers are of sufficient length to permit limited vertical movement of said shoreward edge into and out of contact with the sea-bed so as to permit a bottom-scouring stream of in-rushing of breakers to flow out from under said sheet and so as to direct the flow of said receding wave into a stream above said sheet and out of direct contact with the sea-bed.

6. The assembly of claim 4 further characterized by an elongated flexible weight secured along said shoreward edge of said sheet whereby to sink said edge into conformity with the underlying beach or sea-bed during the backwash cycle of breaking waves and to direct such backwash into a stream above said sheet and out of contact with the sea-bed or beach.

7. A flow control structure for rebuilding and protecting sloping ocean beaches which are subjected to a succession of in-rushing ocean waves each of which is driven up the beach by kinetic energy contained therein and recedes back down the sloping beach in a backwash current to the sea whereby an agitated surf zone is created where said backwash current of each wave encounters the succeeding in-rushing wave causing it to break over the backwash, said structure comprising:

a generally quadrilateral sheet of flexible smooth-surfaced impervious fabric having overall negative buoyancy and at least two substantially parallel edges, adapted to lie on the sea-bed in the said surf zone confronting a beach to be treated and said sheet being oriented with said parallel edges generally parallel to the shoreline one facing seaward and the other shoreward;

a series of relatively rigid elongated floats secured end to end along the seaward edge of said sheet to exert a buoyant force along said edge, tending to raise it from the sea-bed;

a plurality of tethers each connected to one of said floats and extending seaward therefrom to an anchor in the sea-bed whereby said tethers combine to restrain said sheet against the kinetic forces of the in-rush of breakers, and whereby said sheet directs said in-rush into a sea-bed-scouring stream under said sheet said tethers being of such length as to be disposed essentially horizontally when in use;

an elongated flexible weight secured along said shoreward edge of said sheet whereby to sink said edge into conformity with the underlying beach or sea-bed during the backwash cycle of breaking waves and cause said sheet to direct such backwash into a stream above said sheet and out of contact with the sea-bed;

a plurality of shoreward extending tethers and anchorage means attached to the shoreward edge of said sheet to restrain it against seaward movement in response to backwash currents of receding waves; and interconnecting means formed along each lateral edge of said sheet by which it may be joined edge-to-edge with similarly constructed structures to operate in unison therewith.

8. A method of building up ocean beaches and inhibiting the erosion thereof by wave action which comprises the steps of:

directing the in-rush of breaking waves into a relatively high velocity scouring stream along the sea-bed and shoreward onto the beach surface; and directing the out-flow of such waves into a water-surface-adjacent stream out of contact with the sea-bed;

whereby to transport sand particles dislodged by said breaking waves predominantly shoreward.

9. The method of claim 8, further characterized by physically trapping said dislodged particles against the underlying beach and sea-bed during said out-flow.

* * * * *